United States Patent [19]

Droste et al.

[11] 4,074,645

[45] Feb. 21, 1978

[54] CONTROLLED BRAKING DEVICE FOR THE GRIPPER-THREAD BOBBIN OF A DOUBLE LOCK-STITCH SEWING MACHINE

[75] Inventors: Gunter Droste, Leopoldshohe; Klaus-Dieter Seiler, both of Kirchlengern; Wilhelm Stapel, both of Bunde, all of Germany

[73] Assignee: Durkoppwerke GmbH, Bielefeld, Germany

[21] Appl. No.: 751,976

[22] Filed: Dec. 17, 1976

[30] Foreign Application Priority Data

Dec. 19, 1975 Germany ..... 405651

[51] Int. Cl.[2] ..... D05B 63/00

[52] U.S. Cl. ..... 112/229; 242/156

[58] Field of Search ..... 112/229, 231, 228; 242/156, 199, 99

[56] References Cited

U.S. PATENT DOCUMENTS

| | | | |
|---|---|---|---|
| 319,448 | 6/1885 | Brown | 242/156 |
| 699,067 | 4/1902 | Beitzel | 112/229 |
| 1,470,997 | 10/1923 | Miller | 112/229 |
| 3,051,108 | 8/1962 | Ketterer | 112/229 X |
| 4,009,670 | 3/1977 | Mitchell | 112/231 |

FOREIGN PATENT DOCUMENTS

| | | | |
|---|---|---|---|
| 1,043,077 | 9/1966 | United Kingdom | 242/156 |

*Primary Examiner*—George H. Krizmanich
*Attorney, Agent, or Firm*—Karl F. Ross

[57] ABSTRACT

A controlled braking device for the gripper-thread bobbin of a double lock-stitch sewing machine has a braking element which, by means of a brake piston or plunger in the axial bore of the spindle carrying the bobbin, is shiftable to engage the latter. The plunger is engaged by a rod reaching upwardly through an opening in the bottom of the spindle. The brake element is displaced laterally into engagement with the core of the bobbin or axially thereagainst.

9 Claims, 8 Drawing Figures

CONTROLLED BRAKING DEVICE FOR THE GRIPPER-THREAD BOBBIN OF A DOUBLE LOCK-STITCH SEWING MACHINE

FIELD OF THE INVENTION

The invention relates to a controlled braking device for the gripper-thread bobbin of a double lock-stitch sewing machine.

BACKGROUND OF THE INVENTION

A double lock-stitch sewing machine is provided with a bobbin received in a bobbin housing and carrying the thread forming the gripper thread of a double lock stitch. This bobbin tends to overrun, upon excessive thread traction, with sudden starting of the sewing machine or when the pull upon the gripper thread is excessive. Such excessive thread traction can result from the actuation of the thread catcher of a thread-cutting device.

As a result of overrunning of the bobbin, the gripper thread can become tangled and can result, upon further operation of the sewing machine, in nonuniformities of the stitched seam, tearing of the thread and the like.

It has been proposed to avoid the overrunning of the gripper-thread bobbin by providing a bobbin brake which can consist of a thin sheet metal spring forming a brake disk which can be placed around the bobbin-carrying pin and can be disposed between the gripper-thread bobbin and a wall of the bobbin housing. This brake disk presses continuously against the gripper-thread bobbin with a light pressure and resiliently seats against the aforementioned wall of the bobbin housing or socket.

In another system, see for example German Printed Application (Offenlegungsschrift) No. 1,816,564, the gripper thread itself actuates a bobbin brake when thread traction of high intensity is applied. In this case the high traction applied to the thread actuates a brake element applying pressure to the bobbin.

The first-mentioned braking device, which acts continuously against the gripper-thread bobbin in the form of a brake disk, is not satisfactory since it cannot, in all cases, prevent an overrunning of the bobbin when a sudden relatively large thread traction develops, e.g. upon actuation of the thread catcher of a thread-cutting device. If the braking force applied by the brake disk is increased to permit it to successfully prevent overrunning of the bobbin in such cases, an impermissibly large tension is continuously applied to the lower thread of the double lock-stitch seam and adversely effects the formation thereof.

In systems in which the lower thread or under thread of the double lock-stitch seam actuates the bobbin brake built into the bobbin housing, it has been found that elastic threads which have increasingly been of interest in recent times cannot be effectively used since a reliable triggering of the braking mechanism cannot be effected with such yieldable or extensible threads.

It has also been proposed heretofore to provide a controlled braking device in which a brake rod or plunger mounted externally of the bobbin housing is displaced laterally into this housing through an opening to engage the bobbin received therein and brake this bobbin by direct contact. This brake member is generally connected via a lever arrangement with a thread-cutting device of conventional construction and is actuated upon operation of the thread catcher to brake the gripper-thread spool and prevent overrunning of the bobbin by reason of the resulting thread traction.

This known bobbin brake is, however, suitable only for horizontal-shaft grippers, because the vertical-shaft grippers disposed between the stitching plate and the bobbin housing leave little room for providing a brake rod or pin adapted to penetrate into the bobbin housing. A further disadvantage of the latter bobbin brake is that it requires a relatively large actuating stroke to bring the brake rod or plunger into play because considerable space must be provided in the region of the bobbin housing to enable replacement of the gripper-thread bobbin.

OBJECT OF THE INVENTION

It is the object of the present invention to provide a bobbin brake which avoids the drawbacks of the aforedescribed earlier systems but yet achieves the desired result of preventing overrunning of the gripper-thread bobbin of a double lock-stitch sewing machine, and which is particularly suitable for use in combination with a vertical-shaft gripper and requires a minimum of space.

SUMMARY OF THE INVENTION

This object and others which will become apparent hereinafter are attained, in accordance with the present invention, in a controlled brake device for the gripper-thread bobbin of a double lock-stitch sewing machine in which a brake element is provided in the bobbin housing and, upon axial displacement of a plunger shiftable in the bobbin-carrying pin of this housing, engages a portion of the bobbin against the force of a spring to frictionally brake the bobbin.

According to a feature of the invention, the brake plunger is received in an axial bore of the bobbin-carrying spindle or pin and is axially aligned with a bore extending through the hollow gripper shaft of the sewing machine. An actuating rod is axially shiftable in the bore of the horizontal gripper shaft and is normally retracted below the bottom of the concavity forming the bobbin housing but can be displaced through the bottom of this housing to engage the plunger. To this end, a wall of the bobbin-carrying spindle of the housing is provided with an opening through which the brake element is brought into direct contact with a portion of the bobbin.

According to another feature of the invention, the brake element is a ball while the brake plunger is formed with an inclined camming surface which biases the ball laterally through the aforementioned opening into engagement with the bobbin.

In another embodiment of the invention, the brake element can have a pair of radially extending formations which are mounted upon the brake plunger and engage the bottom of the bobbin, these formations being received in recesses or cutouts formed in the floor of the bobbin housing.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
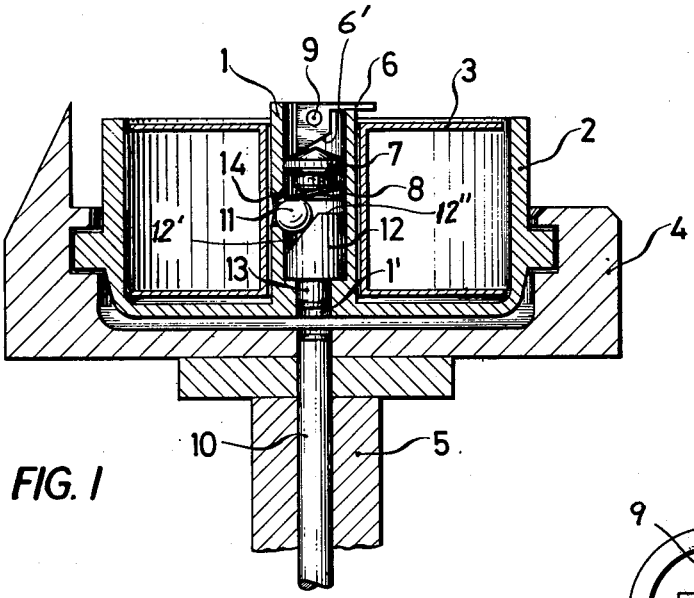
FIG. 1 is a vertical cross-sectional view of a brake device according to one embodiment of the invention in which the brake element is a ball displaceable by an inclined camming surface.
Figure 3:
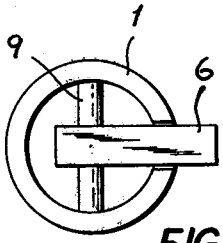
FIG. 3 is a plan view of the top of the bobbin-carrying spindle.

The two embodiments of the brake device according to the present invention are shown respectively in FIGS. 1 - 4 and FIGS. 5 - 8. In the first embodiment the brake element is a laterally displaceable ball which is cammed outwardly by an inclined surface upon axial movement of the brake plunger while, in the second embodiment, the brake element is a pair of radial formations formed on the plunger and which axially engage the bobbin.

In each of the two braking devices, the bobbin-carrying spindle 1 is mounted upon the bobbin housing 2 in which the bobbin 3 is removably received. The bobbin can comprise upper and lower horizontal flanges **3*b* and 3*c* carried by a hollow core 3*a* in the conventional manner. The gripper thread has not been shown but is wound on the bobbin between the flanges 3*b* and 3*c* around the core 3*a***.

The bobbin housing may be closed by a cover 21 (FIGS. 5 and 6) in the usual manner.

Moreover, the bobbin housing 2 is rotatably received in a rotating double lock-stitch gripper of conventional construction and having a vertical shaft, namely, the gripper shaft 5 which is driven by conventional bevel gearing from the gripper drive shaft.

The double lock-stitch gripper 4, with the bobbin housing 2, 21, is part of a conventional double lock-stitch sewing machine construction, for example an industrial fast stitching machine.

The braking device, however, differs from conventional types in construction and function.

According to the invention, there is provided, at the top of the bobbin-carrying spindle 1, a retaining flap 6 which is pivotally mounted on a pin 9 which serves to retain the removable cover 21 (see especially FIGS. 5 and 6) by overhanging a portion thereof.

Figure 2:
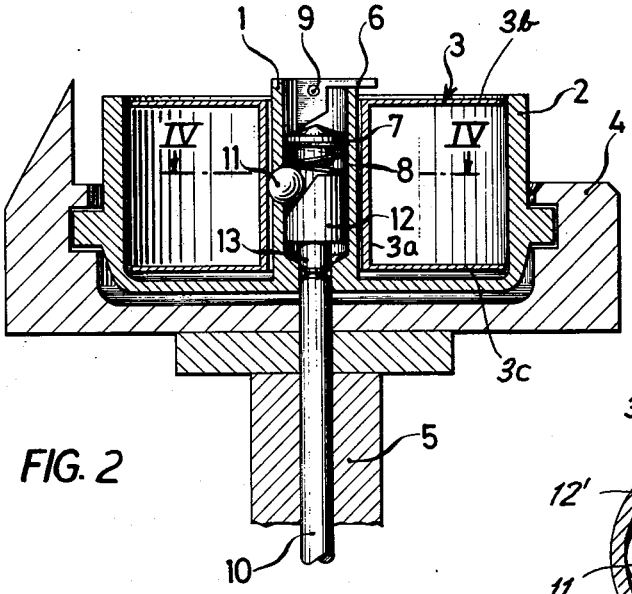
FIG. 2 is a view similar to FIG. 1 in the actuated position of the bobbin brake.
Figure 4:
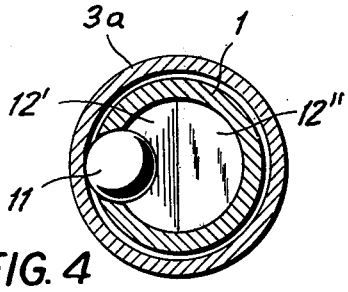
FIG. 4 is a cross-sectional view taken along the line IV — IV of FIG. 2.
Figure 5:
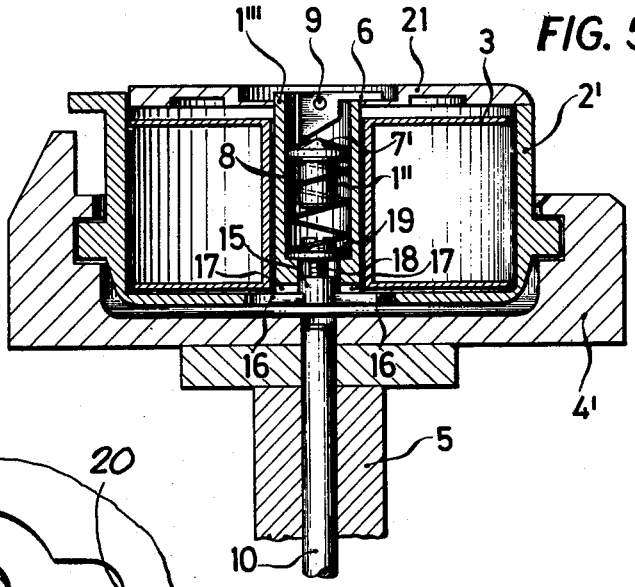
FIG. 5 is a view similar to FIG. 1 illustrating a brake device according to a second embodiment of the invention in which a pair of radially extending formations are engageable with the bobbin and form the brake element.
Figure 8:
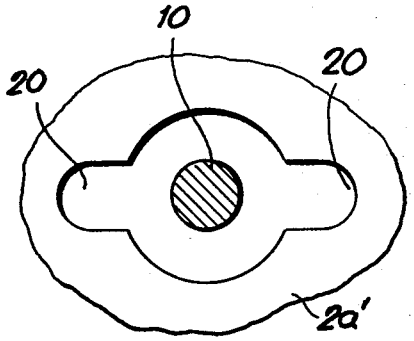
FIG. 8 is a view taken along the line VIII — VIII of FIG. 6.
Figure 7:
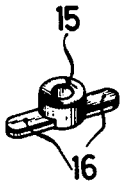
FIG. 7 is a perspective view of the brake element and plunger according to the invention.
Figure 6:
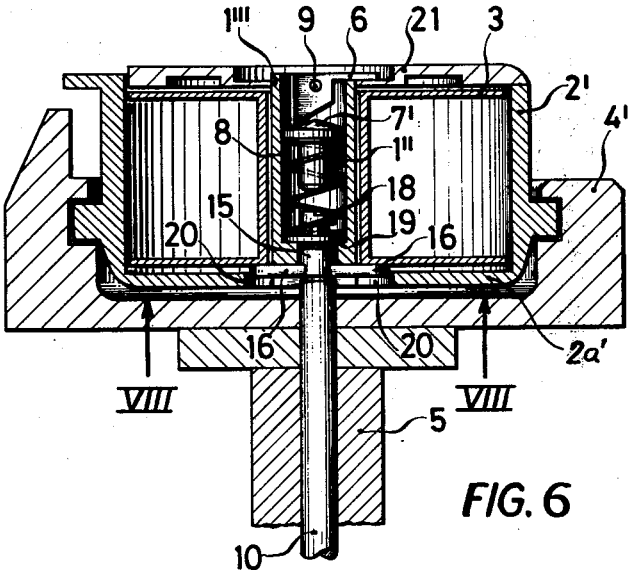
FIG. 6 is a view similar to FIG. 5 showing the brake in its actuating position.

FIGS. 1 and 5 show the respective brakes in their inactive positions in which the brake elements are disengaged from the bobbin, while FIGS. 2 and 6 respectively show the brakes in the actuated positions.

The two brakes are actuated in a similar manner via an actuating pin or rod 10 which extends through the hollow gripper shaft 5 and projects into an axial bore 1' of the bobbin-carrying spindle 1 and engages a brake plunger which operates the brake elements. In FIGS. 1 and 2, of course, the brake element is a ball 11 whereas in FIGS. 5 and 6 the brake element is a pair of radial formations 16 on the plunger 15.

Referring now to FIGS. 1 through 4 in greater detail, it will be apparent that the brake element or ball 11 is actuated by a brake plunger 12 having an inclined camming surface 12' which cams the ball 11 laterally through an opening 14 in the spindle 1 when the rod 10 is displaced upwardly.

A planar face of the plunger 12 can bear against a spring 8 at 12'', the spring 8 serving as a restoring spring and reacting against a spring pin 7 whose frustoconical top bears against an inclined surface 6' of the flap 6 so that the cap 6 is also spring-loaded into its closed position by the spring 8.

Normally (FIG. 1), the spring 8 presses the ball 11 downwardly and radially inwardly, out of the bore 14 and hence out of engagement with the core **3*a* of the bobbin 3. However, when the rod 10 is urged upwardly, it engages a boss 13 of the plunger 12 and presses the latter upwardly against the force of spring 8 to cam the ball 11 outwardly through bore 14 and into engagement with the inner surface of the bobbin 3. When the rod 10 is no longer urged upwardly, spring 8 shifts the ball 11** downwardly and inwardly to disengage the thread brake.

In the embodiment of FIGS. 5 through 8, the plunger 15 is provided directly with radial formations 16 which normally lie in cutouts 20 provided in the floor **2*a'* of the bobbin housing 2'**.

The plunger 15 is here axially shiftable in an axial bore 1'' of the bobbin-carrying spindle 1'''.

The axial bore 1'' has, at its upper portion, a larger diameter to accommodate the retaining flap 6, the spring pin 7' and the compression spring 8 whose functions have already been described. The small-diameter lower portion of the bore 1'', however, accomodates the plunger 15 with the radially extending formation 16.

The spindle 1''' also is formed at its lower end with two openings 17 turned toward the bobbin 3 and in which the formation 16 can project to engage the bobbin 3 directly. The opening can be milled into the spindle 1'''.

When the rod 10 is urged upwardly, therefore, the plunger 15 is likewise lifted and brought into engagement with the bobbin 3 which can be frictionally braked by the formation 16 directly and urged against the cover 21 for further braking action.

As soon as the rod 10 is no longer effective, the plunger 15 falls into the position shown in FIG. 5 to disengage from the bobbin 3. This downward movement of the plunger 15 is effected by gravity under its own weight.

The downward movement of plunger 15 is limited by a cap screw 18 which is threaded into the plunger 15 and has a head engageable with a washer 19 against which the spring 8 reacts. The washer 19 is dimensioned to rest upon the shoulder formed between the large and small diameter bores of the spindle 1''. Preferably the screw 18 is adjusted so that the underside of the formation 16 and the plunger 15 lies flush with the underside of the bottom **2*a'* of the bobbin housing. The cap screw 18 can have a slot adapted to receive a screwdriver which can be inserted through the spindle 1''' to adjust the position of the plunger 15 and the formation 16**.

In this embodiment, the spring retaining the flap 6 has no effect on the braking action. The spring 8 and the washer 19 are dimensioned such that the spring does not act upon the screw 18 which, however, can be guided in the washer 19 while the washer 19 is itself cosely fitted within the large-diameter bore of the spindle 1''' to function as a guide for the plunger 15.

In both embodiments, the rod 10 is actuated by the thread-cutting device, as in the prior-art systems described above, so that the thread brake is activated when the thread catcher is actuated and sudden thread traction is generated to prevent overrunning of the bobbin.

In such systems, the rod can be actuated by the arm shaft of the sewing maching in an appropriate cadence so that the brake is effective only when the formation of the upper thread loop terminates and thus interference between the braking action and the formation of the upper thread loop is precluded. Rod 10 can also be actuated, if desired, by a solenoid magnet coil or the like by a control pulse which is triggered upon actuation of the thread-cutting device or a fabric stacker, or simply upon switching off of the sewing machine to prevent overrunning of the bobbin in these cases.

We claim:

1. A gripper-thread bobbin brake for a double lock-stitch sewing machine which comprises the combination with a bobbin housing having a spindle adapted to receive a bobbin with a core of the bobbin surrounding said spindle, and a gripper-shaft axially aligned with said housing and said spindle, of:

a brake element in said housing juxtaposed with said bobbin;

a brake plunger received in said spindle and axially displaceable therein for shifting said brake element into engagement with said bobbin; and an actuating rod extending through said shaft and engageable with said plunger for displacing same to engage said element with said bobbin, said spindle being provided with at least one opening, said element projecting through said opening into engagement with said bobbin upon actuation of said rod.

2. The brake defined in claim 1 wherein said element is a ball and said opening is a bore in said spindle confronting a core of said bobbin, said plunger being formed with an inclined surface camming said ball against said bobbin upon axial displacement of said plunger.

3. The brake defined in claim 2, further comprising a spring received in said spindle and urging said ball and said plunger in a direction opposite the direction of displacement of said plunger by said rod to engage said ball with said bobbin.

4. The brake defined in claim 3, further comprising a flap pivotally mounted on said spindle, a spring pin bearing against said flap for retaining same in a closed position, said spring bearing against said spring pin.

5. The brake defined in claim 1 wherein said brake element is a radially extending formation on said plunger, said housing having a bottom formed with a recess receiving said formation in a position thereof disengaged from said bobbin.

6. The brake defined in claim 5 wherein said spindle is formed with a stepped bore having a large-diameter upper portion and a small-diameter lower portion, said portions defining a shoulder between them, said plunger being guided in said lower portion and carrying a screw for limiting the displacement of said plunger upon disengagement of said rod therefrom.

7. The brake defined in claim 6, further comprising a washer resting on said shoulder and engageable with by a head of said screw to limit the displacement of said plunger.

8. The brake defined in claim 7, further comprising a spring received in said spindle and bearing against said washer.

9. The brake defined in claim 8 wherein said spindle is provided with a pivotal flap, said spring bearing against said flap to retain the same in a closed position.

* * * * *